US012359358B2

(12) United States Patent
Gnadeberg et al.

(10) Patent No.: US 12,359,358 B2
(45) Date of Patent: Jul. 15, 2025

(54) LAUNDRY TREATMENT APPLIANCE HAVING SELECTABLE TREATMENT AGENT CONTROL MODES

(71) Applicant: Electrolux Appliances Aktiebolag, Stockholm (SE)

(72) Inventors: Hugo Gnadeberg, Stockholm (SE); Paolo Quattrin, Porcia (IT); Luca Da Re, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 1003 days.

(21) Appl. No.: 17/268,779

(22) PCT Filed: Aug. 28, 2019

(86) PCT No.: PCT/EP2019/072948
§ 371 (c)(1),
(2) Date: Feb. 16, 2021

(87) PCT Pub. No.: WO2020/043770
PCT Pub. Date: Mar. 5, 2020

(65) Prior Publication Data

US 2021/0180235 A1 Jun. 17, 2021

(30) Foreign Application Priority Data

Aug. 30, 2018 (EP) ..... 18191671
Mar. 27, 2019 (EP) ..... 19165533

(51) Int. Cl.
*D06F 33/37* (2020.01)
*D06F 39/02* (2006.01)
(Continued)

(52) U.S. Cl.
CPC ..... *D06F 33/37* (2020.02); *D06F 39/02* (2013.01); *D06F 39/022* (2013.01);
(Continued)

(58) Field of Classification Search
CPC ..... D06F 34/37; D06F 39/022
See application file for complete search history.

(56) References Cited

U.S. PATENT DOCUMENTS 10,465,327 B2 * 11/2019 Lv ..... D06F 39/026
2010/0006593 A1 1/2010 Hellweg
(Continued)

FOREIGN PATENT DOCUMENTS

EP 1884584 A2 * 2/2008 ..... D06F 39/022
EP 2602378 A1 6/2013
(Continued)

OTHER PUBLICATIONS

International Search and Written Opinion for International Application No. PCT/EP2019/072948, Nov. 21, 2019, 9 pages.

*Primary Examiner* — Joseph L. Perrin
*Assistant Examiner* — Kevin G Lee
(74) *Attorney, Agent, or Firm* — Bradley Arant Boult Cummings LLP

(57) ABSTRACT

A laundry treatment appliance having a treatment cycle a drawer with a compartments for treatment agents; metering devices to draw doses from the compartments; and a control unit to control the metering devices according to a selected control mode. In a first mode, one metering device draws treatment agent dose during one of two phases, and the other metering is kept off during both phases. In a second mode, both metering devices draw up treatment agent doses during at least one of two phases. In a third mode one metering device draws treatment agent during one phase of two phases, and the other metering device draws up treatment agent dose during the other of two phases.

16 Claims, 6 Drawing Sheets

(51) Int. Cl.

| | |
|---|---|
| *D06F 101/00* | (2020.01) |
| *D06F 103/00* | (2020.01) |
| *D06F 105/42* | (2020.01) |
| *D06F 105/58* | (2020.01) |

(52) U.S. Cl.
CPC ..... *D06F 2101/00* (2020.02); *D06F 2103/00* (2020.02); *D06F 2105/42* (2020.02); *D06F 2105/58* (2020.02)

(56) References Cited

U.S. PATENT DOCUMENTS

| | | | | |
|---|---|---|---|---|
| 2012/0011662 | A1* | 1/2012 | Yusuf | D06F 33/36 8/137 |
| 2019/0024286 | A1* | 1/2019 | Adams | D06F 33/37 |
| 2019/0271107 | A1* | 9/2019 | Bensel | D06F 39/024 |

FOREIGN PATENT DOCUMENTS

| | | | | |
|---|---|---|---|---|
| GB | 2311767 | A | 10/1997 | |
| JP | 7492547 | B2 * | 5/2024 | D06F 34/04 |
| WO | 2011029766 | A1 | 3/2011 | |

* cited by examiner

LAUNDRY TREATMENT APPLIANCE HAVING SELECTABLE TREATMENT AGENT CONTROL MODES

This application is a U.S. National Phase application of PCT International Application No. PCT/EP2019/072948, filed Aug. 28, 2019, which claims the benefit of European Application No. 19165533.1, filed Mar. 27, 2019, and European Application No. 18191671.9, filed Aug. 30, 2018, each of which are incorporated by reference herein.

FIELD OF THE INVENTION

The present invention generally relates to the field of laundry treatment appliances (hereinafter, concisely, "laundry appliances"), and particularly to laundry appliances for treating, e.g. washing, items (such as linen, clothes, garments, shoes, and the like), such as laundry washing appliances and laundry washing appliances also implementing laundry drying functions (also referred to as washers/dryers). More particularly, the present invention relates to a laundry appliance with an improved system for delivering of laundry treatment agent.

BACKGROUND OF THE INVENTION

A laundry appliance typically comprises a drawer having drawer compartments for containing one or more laundry treatment agents (hereinafter, concisely, "treatment agents"). In an increasingly common type of laundry appliance, the drawer comprises one or more compartments each one adapted to contain multiple doses of a respective treatment agent for performing multiple treatment cycles (hereinafter referred to as multi-dose compartments): just as an example, in case of two multi-dose compartments, a multi-dose compartment may be arranged to contain multiple doses of a liquid washing detergent, whereas the other multi-dose compartment may be arranged to contain multiple doses of a liquid softener. In this class of laundry appliance, the laundry appliance may implement an auto-dosing functionality in which, at each treatment cycle (and when the auto-dosing functionality is activated), a predetermined amount of treatment agent (usually referred to as treatment agent dose) is automatically taken from the multi-dose compartment(s) (e.g., by means of one or more pump devices associated therewith) and dispensed to a treatment chamber (such as a washing tub).

SUMMARY OF INVENTION

The Applicant has realized that the typical laundry appliances comprising an auto-dosing system implementing auto-dosing functionalities are not satisfactory since they lack of versatility.

Indeed, although known auto-dosing systems allow to improve the immediacy of use of basic operations, such as allowing users to start a treatment cycle by simply interacting with the user interface of the laundry appliance without having to open the drawer and manually pouring washing detergent (and additionally softener), the automation degree offered by known solutions cannot be efficiently customable in order to respond to the needs and habits of the users.

For example, a laundry appliance equipped with an auto-dosing system configured to have a first multi-dose compartment which is arranged to contain multiple doses of a liquid washing detergent only and a second multi-dose compartment which is arranged to contain multiple doses of a liquid softener only, is not suited for a user which is used to wash laundry without employing softener products. In this case, it is not possible to fully exploit the automation capabilities offered by this peculiar auto-dosing system, since in this case, the second multi-dose compartment is left always empty and never used.

Moreover, by employing a known auto-dosing system configured to have a first multi-dose compartment which is arranged to contain multiple doses of a liquid washing detergent only and a second multi-dose compartment which is arranged to contain multiple doses of a liquid softener only, the user is forced to always use the same type of washing detergent stored in the first multi-dose compartment for different treatment cycles as long as there is still washing detergent stored in said first multi-dose compartment. If instead the user wanted to change washing detergent for a single treatment cycle (for example, for using a specific delicate washing detergent for performing a delicate treatment cycle when the first multi-dose compartment is still containing one or more doses of a washing detergent not suitable for washing delicate laundry), the user would be forced to manually empty the first multi-dose compartment to remove the previous washing detergent and manually substituting it with the new detergent.

In view of the above, it is an object of the present invention to provide a laundry appliance able to overcome these, as well as other, drawbacks, and particularly it is an object of the present invention to provide a laundry appliance equipped with an improved auto-dosing system implementing auto-dosing functionalities in a versatile and flexible way.

One or more aspects of the present invention are set out in the independent claims, with advantageous features of the same invention that are indicated in the dependent claims.

An aspect of the present invention relates to a laundry treatment appliance for treating laundry according to a selected one among a plurality of treatment cycles.

According to an embodiment of the present invention, at least one treatment cycle comprises a first phase and a second phase.

According to an embodiment of the present invention, the laundry treatment appliance comprises a drawer comprising a first compartment and a second compartment.

According to an embodiment of the present invention, the first compartment is adapted to contain multiple doses of a first type of laundry treatment agent and the second compartment is adapted to contain multiple doses of the first type of laundry treatment agent or of a second type of laundry treatment agent.

According to an embodiment of the present invention, the laundry treatment appliance comprises first and second metering devices adapted to draw up treatment agent doses from the first and second compartments, respectively.

According to an embodiment of the present invention, the laundry treatment appliance further comprises a control unit adapted to control the first and second metering devices.

According to an embodiment of the present invention, the laundry treatment appliance further comprises a selection unit adapted to select a control mode among a first, second and third control modes.

According to an embodiment of the present invention, the control unit is configured to control the first and second metering devices according to the selected control mode.

According to an embodiment of the present invention, the control unit is configured to control the first and second metering devices according to the selected control mode in case said at least one treatment cycle comprising a first phase and a second phase is selected.

According to an embodiment of the present invention, in the first control mode, a selected metering device between said first and second metering devices is caused to draw up a treatment agent dose during a selected phase between the first phase and the second phase, and the other metering is kept off during both the first and second phases.

According to an embodiment of the present invention, in the second control mode, both said first and second metering devices are caused to draw up treatment agent doses during at least one between the first phase and the second phase.

According to an embodiment of the present invention, in the third control mode, a selected metering device between said first and second metering devices is caused to draw up a treatment agent dose during a selected one phase between the first phase and the second phase, and the other metering device is caused to draw up a treatment agent dose during another phase between the first phase and the second phase Preferably, the first phase corresponds to a first treatment type.

Preferably, the second phase corresponds to a second treatment type different from the first treatment type.

According to an embodiment of the present invention, the laundry treatment appliance comprises at least one input selector for allowing a user to input selection commands.

According to an embodiment of the present invention, the selection unit being configured to select the control mode according to said selection commands input by the user.

According to an embodiment of the present invention, said at least one input selector is associated with a corresponding set of control modes comprising at least one among said first, second and third control modes and is configured to allow the user to input selection commands to select a control mode among the corresponding set of control modes.

According to an embodiment of the present invention, at least one input selector is configurable through an external device being external to the laundry treatment appliance for adding/removing control modes from the corresponding set of control modes.

According to an embodiment of the present invention, the selection unit is further configured to receive input selection commands through an external device being external to the laundry treatment appliance.

According to an embodiment of the present invention, said at least one input selector is provided on said external device.

According to an embodiment of the present invention, the control unit is further configured to identify the type of laundry treatment agent contained in the first compartment and/or the type of laundry treatment agent contained in the second compartment according to information input by a user, and/or information generated by laundry treatment agent sensors located at the first and/or second compartments.

According to an embodiment of the present invention, the control unit is configured to configure at least one input selector by adding/removing control modes from the corresponding set of control modes according to the identified type of laundry treatment agent contained in the first compartment and/or the type of laundry treatment agent contained in the second compartment.

According to an embodiment of the present invention, the control unit is further configured to assess a correct or incorrect status of the selected control mode based on the identified types of laundry treatment agent, and, in case of an incorrect status is assessed, carry out at least one among the following operations:

generate a warning;

prevent the first and second metering devices to draw up treatment agent doses from the first and/or second compartments;

deselect the selected control mode.

According to an embodiment of the present invention, the control unit is configured to assess a correct status if:

the first control mode is selected;

the first compartment contains at least a dose of the first type of laundry treatment agent and the second compartment contains at least a dose of the second type of laundry treatment agent.

According to an embodiment of the present invention, said first and second types of laundry treatment agents are two different laundry detergents.

According to an embodiment of the present invention, the control unit is configured to assess an incorrect status if the first control mode is selected, and the first and second compartments contain at least a dose of the first type of laundry treatment agent.

According to an embodiment of the present invention, the control unit is configured to assess a correct status if:

the second control mode is selected;

the first compartment contains at least a dose of the first type of laundry treatment agent and the second compartment contains at least a dose of the first type of laundry treatment agent.

According to an embodiment of the present invention, said first type of treatment agent is a laundry detergent.

According to an embodiment of the present invention, the control unit is configured to assess an incorrect status if the second control mode is selected, the first compartment contains at least a dose of the first type of laundry treatment agent, and the second compartment contains at least a dose of the second type of laundry treatment agent.

According to an embodiment of the present invention, the control unit is configured to assess a correct status if:

the third control mode is selected;

the first compartment contains at least a dose of the first type of laundry treatment agent and the second compartment contains at least a dose of the second type of laundry treatment agent.

According to an embodiment of the present invention, said first type of laundry treatment agent is a laundry detergent and said second type of laundry treatment agent is a softener.

According to an embodiment of the present invention, the control unit is configured to assess an incorrect status if the third control mode is selected, and the first and second compartments contain at least a dose of the first type of laundry treatment agent.

According to an embodiment of the present invention, said first metering device comprises a first pump device and said second metering device comprises a second pump device.

According to an embodiment of the present invention, said metering device comprises valve devices and/or hydraulic systems comprising Venturi pipes.

According to an embodiment of the present invention, the control unit is configured to cause the first and second pump devices to draw up the laundry treatment agent doses by controlling rotor speeds of the first and second pump devices, and/or by controlling activation times of the first and second pump devices.

According to an embodiment of the present invention, said first phase and said second phase are selected among:

a prewashing phase;

a washing phase;

a rinsing phase.

Another aspect of the present invention relates to a method for operating a laundry treatment appliance for treating laundry according to a selected one among a plurality of treatment cycles.

According to an embodiment of the present invention, at least one treatment cycle comprises a first phase and a second phase.

According to an embodiment of the present invention, the laundry treatment appliance comprises a drawer comprising a first compartment and a second compartment.

According to an embodiment of the present invention, the first compartment is adapted to contain multiple doses of a first type of laundry treatment agent and the second compartment is adapted to contain multiple doses of the first type of laundry treatment agent or of a second type of laundry treatment agent.

According to an embodiment of the present invention, the laundry treatment appliance comprises first and second metering devices adapted to draw up treatment agent doses from the first and second compartments, respectively.

According to an embodiment of the present invention, the method comprises selecting a control mode among a first, second and third control modes.

According to an embodiment of the present invention, the method comprises controlling the first and second metering devices according to the selected control mode.

According to an embodiment of the present invention, the method further comprises controlling the first and second metering devices according to the selected control mode in case said at least one treatment cycle comprising a first phase and a second phase is selected.

According to an embodiment of the present invention, in the first control mode, a selected metering device between said first and second metering devices is caused to draw up a treatment agent dose during a selected phase between the first phase and the second phase, and the other metering is kept off during both the first and second phases.

According to an embodiment of the present invention, in the second control mode, both said first and second metering devices are caused to draw up treatment agent doses during at least one between the first phase and the second phase.

According to an embodiment of the present invention, in the third control mode a selected metering device between said first and second metering devices is caused to draw up a treatment agent dose during a selected one phase between the first phase and the second phase, and the other metering device is caused to draw up a treatment agent dose during another phase between the first phase and the second phase.

According to an embodiment of the present invention, the method further comprises:

having a user input selection commands;

selecting the control mode according to said selection commands input by the user.

According to an embodiment of the present invention, the method further comprises receiving input selection commands through an external device being external to the laundry treatment appliance.

According to an embodiment of the present invention, the method further comprises identifying the type of laundry treatment agent contained in the first compartment and/or the type of laundry treatment agent contained in the second compartment according to information input by a user, and/or information generated by laundry treatment agent sensors located at the first and/or second compartments.

According to an embodiment of the present invention, the method further comprises assessing a correct or incorrect status of the selected control mode based on the identified types of laundry treatment agent, and, in case of an incorrect status is assessed, carrying out at least one among the following operations:

generate a warning;

prevent the first and second metering devices to draw up treatment agent doses from the first and/or second compartments;

deselect the selected control mode.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read making reference to the attached drawings, wherein.

DETAILED DESCRIPTION OF PREFERRED EMBODIMENTS OF THE INVENTION

Figure 1A:
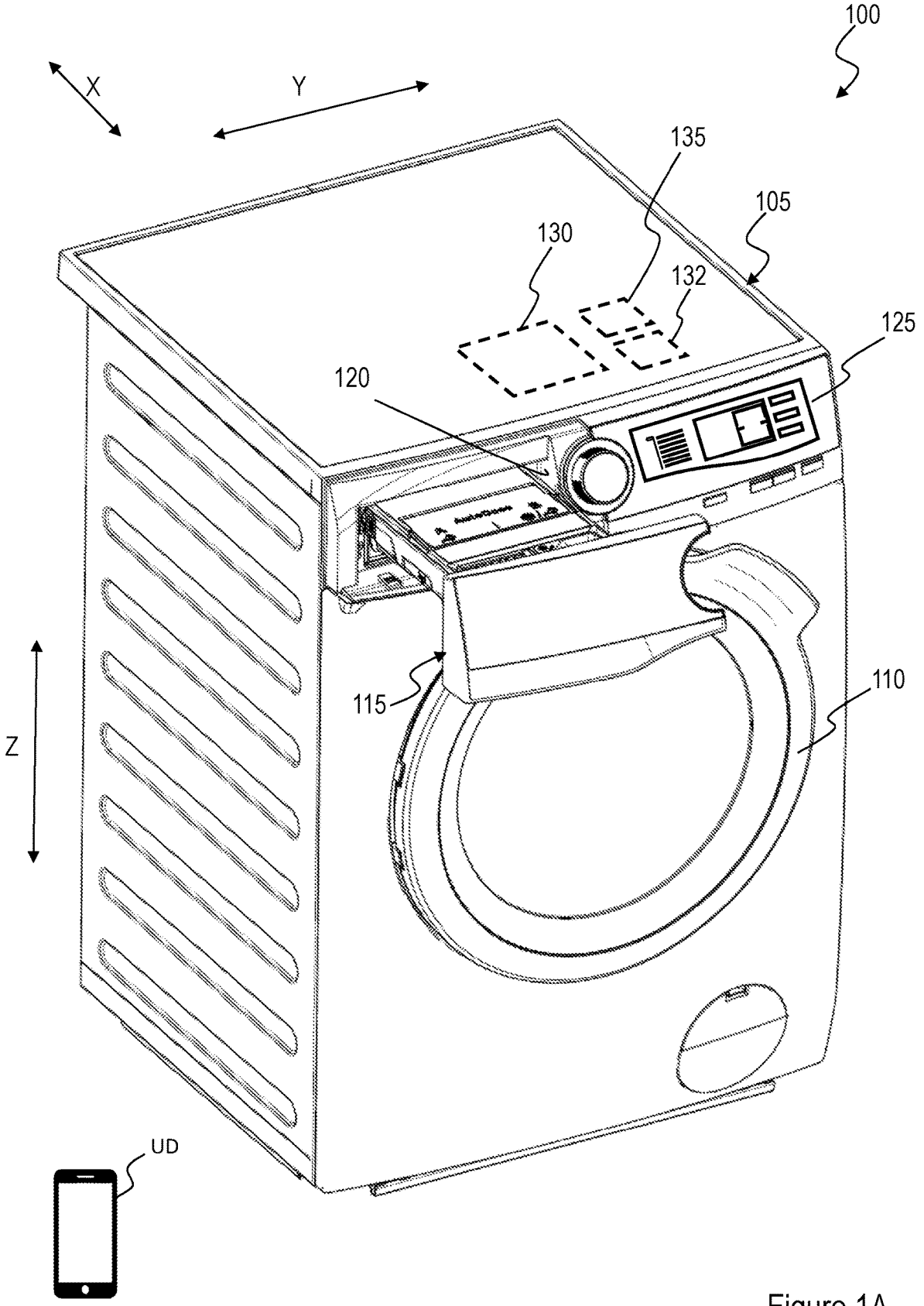
FIGS. 1A and 1B show perspective views of a laundry appliance according to an embodiment of the present invention.
Figure 1B:
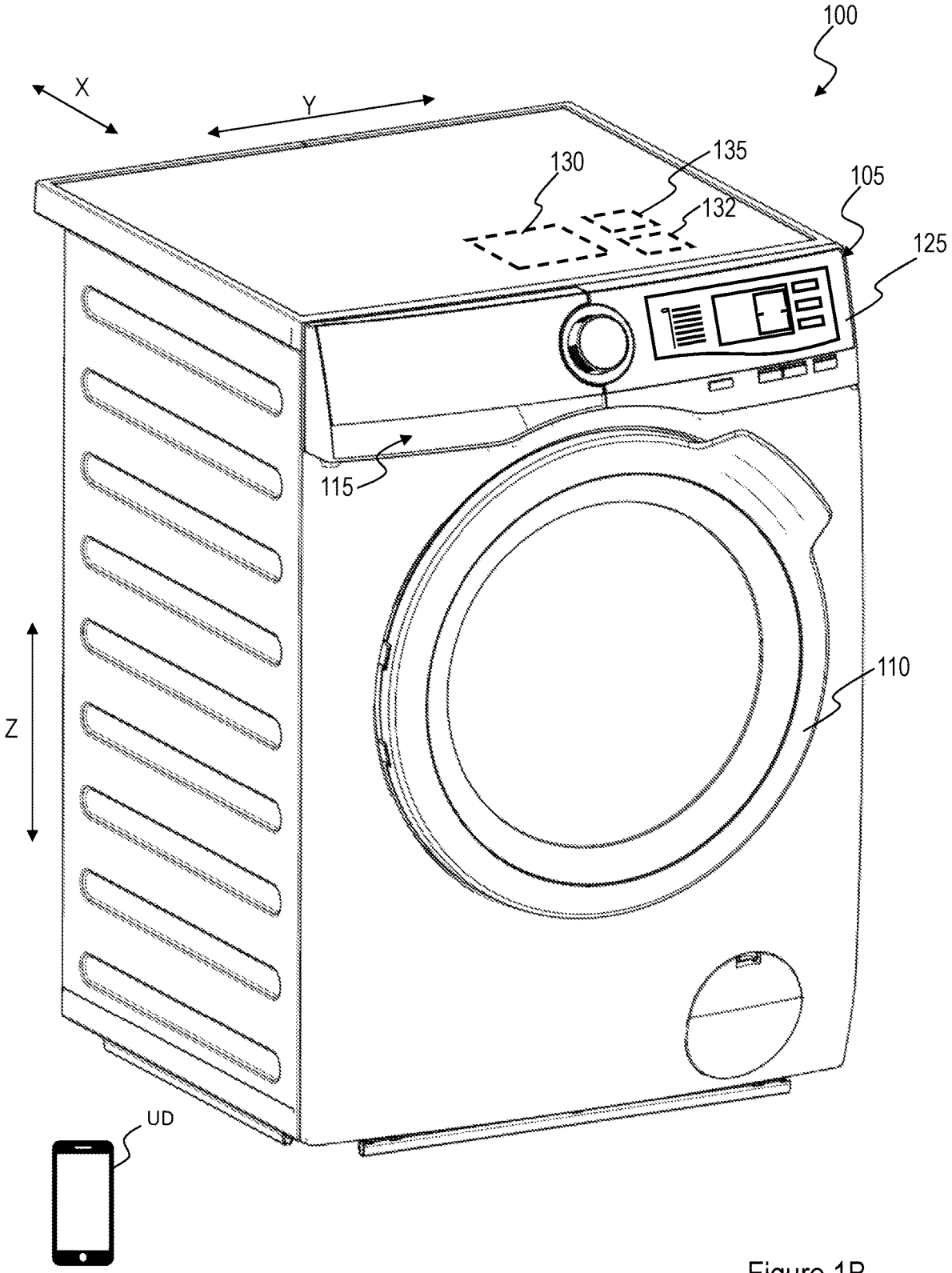

With reference to the drawings, FIGS. 1A and 1B show perspective views of a laundry appliance 100 according to an embodiment of the present invention. According to the exemplary, not limiting, embodiment herein considered, the laundry appliance 100 is a washing machine. In any case, although in the following description explicit reference will be made to a washing machine, this should not to be construed as a limitation; indeed, the present invention applies to other types of laundry appliances (for example combined washers/dryers, i.e. washing machines also having laundry drying functions).

The laundry appliance 100 comprises a (e.g., parallepiped-shaped) cabinet 105, which preferably accommodates a treatment chamber (i.e., a laundry washing chamber in the example herein considered of a washing machine) for performing a treatment cycle on laundry load housed therein (e.g., a treatment cycle or program in the example herein considered of a washing machine).

The treatment chamber preferably comprises a washing tub (not shown) and, within it, a (e.g., rotatable) washing basket or drum (not shown) adapted to contain the laundry load to be washed. A cabinet front has a loading opening providing an access to the drum for loading/unloading the laundry load, a door 110 (shown in a closed position in FIGS. 1A and 1B) being provided for sealably closing the loading opening during the operation of the laundry appliance 100.

Although not shown, the laundry appliance 100 also comprises, enclosed in the cabinet 105, electrical/electronic/mechanical/hydraulic components for the operation of the laundry appliance 100 (such as for example motor, electromechanical valves, pump devices and impellers of the hydraulic apparatus, one or more heating elements for heating water/treatment agents/air).

The laundry appliance 100 further comprises a drawer 115 for containing one or more laundry treatment agents (or, concisely, treatment agents), such as liquid and powder treatment agents including, but not limited to, washing detergents, rinsing detergents, bleaches and softeners. The laundry appliance 100 also comprises a drawer seat 120 (preferably provided on a top part of a cabinet front) for housing the drawer 115, the drawer 115 being advantageously adapted to slide within the drawer seat 120, along a longitudinal or sliding direction X, between an extracted position (shown in FIG. 1A) and a retracted position (shown in FIG. 1B). The sliding direction X is for example parallel to a rest surface, such as the floor, on which the laundry appliance 100 preferably rests in operation (i.e., when it is installed in the user premises). In operation, the laundry appliance 100 rests on the rest surface, such as the floor, and uprightly extends from it along a vertical direction Z orthogonal to the sliding direction X.

Preferably, the laundry appliance 100 further comprises a user interface 125, the user interface 125 being preferably provided on the top part of the cabinet front, more preferably next to the drawer seat 120 along a transversal direction Y orthogonal to the longitudinal X and vertical Z directions. An exemplary user interface 125 will be shown and described in the following when discussing control modes of the laundry appliance according to embodiments of the present invention.

Preferably, the laundry appliance 100 is further provided with a control unit 130 for controlling the laundry appliance 100 (the control unit 130 being schematically illustrated as a dashed rectangle in FIGS. 1A and 1B) according to instructions received by a user through the user interface 125. For example, the control unit 130 is configured to provide power and to interact with the electrical/electronic/mechanical/hydraulic components in order to manage the execution of selected treatment cycles.

According to an embodiment of the present invention, the laundry appliance 100 comprises a selection unit 132 (the selection unit 132 being schematically illustrated as a dashed rectangle in FIGS. 1A and 1B) for selecting control modes of the laundry appliance 100 among a group of available control modes as will be described later on.

Moreover, as will be described in greater details in the following of the present description, the control unit 130 is arranged to coordinate a drawing up of the treatment agents contained in the drawer 115 according to a control mode selected by the selection unit 132 among the available control modes.

As illustrated in FIGS. 1A and 1B, the laundry appliance 100 preferably comprises a connection device 135 (for example a network interface controller or network adapter, schematically illustrated as a dashed rectangle in the figures) for allowing a (e.g., wired or wireless) data exchange between the laundry appliance 100 and an external device, for example a user device UD, being external to the laundry appliance 100. The user device UD may for example be a personal digital assistant (PDA), a smartphone (as herein exemplary illustrated), a tablet, a wearable smart device (such as a smartwatch) or other mobile device having processing, input/output and memory units adapted to run software applications (i.e. mobile applications in the example at issue of a smartphone as user device UD).

According to an embodiment of the present invention, the mobile application run by (i.e., running on) the user device UD is advantageously adapted to present to the user at least a subset of functionalities and/or settings and/or options and/or control modes allowed by user interface 125.

Preferably, the mobile application running on the user device UD may be advantageously adapted to present to the user one or more additional functionalities and/or additional settings and/or additional options and/or additional control modes to be selected (as better discussed in the following).

Figure 2A:
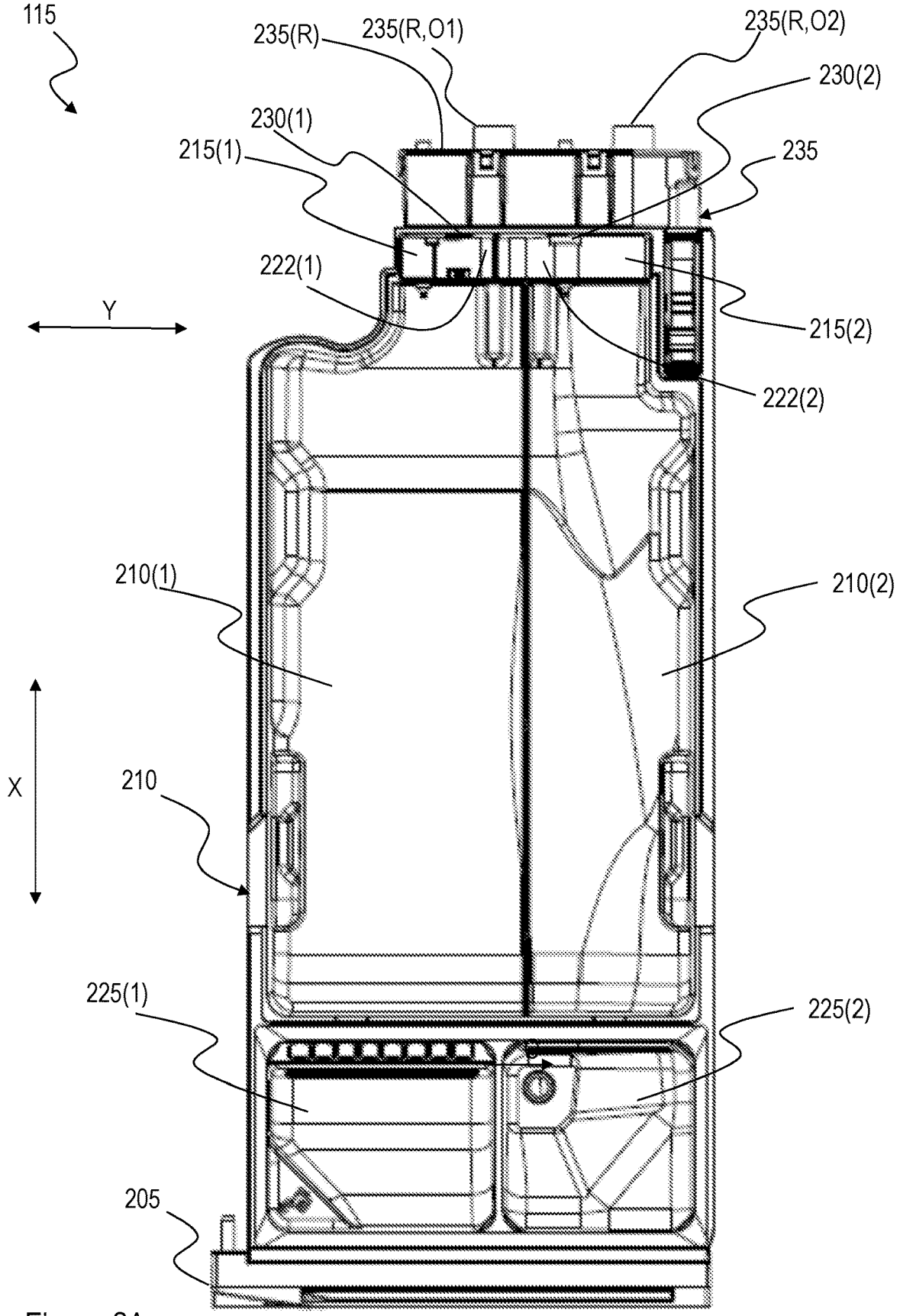
FIG. 2A shows a top view of a drawer of the laundry appliance according to an embodiment of the present invention.

With reference now also to FIG. 2A, it shows top views of the drawer 115 according to an embodiment of the present invention. For ease of description, FIG. 2A will be discussed together with FIG. 2B, which shows a perspective view of the drawer 115 in a partially extracted position within the drawer seat 120.

The drawer 115 preferably comprises a drawer handle 205 allowing the user to slidably move the drawer 115 between the extracted position and the retracted position when it is fitted in the drawer seat 120, and a drawer body 210 to which the drawer handle 205 is adapted to be mounted or coupled or connected (advantageously, in a removable or reversible way). When the laundry appliance 100 is installed and the drawer 115 is fitted in the drawer seat 120, the drawer handle 205 identifies, along the sliding direction X, a drawer front (which advantageously forms part of the cabinet front when the drawer 115 is in the retracted position).

The drawer 115 (particularly, the drawer body 210) preferably comprises two drawer compartments 210(1), 210(2) (or more thereof) each one adapted to contain multiple doses of a respective treatment agent for multiple laundry treatments (e.g., multiple treatment cycles), hereinafter referred to as multi-dose compartments 210(1),210(2); therefore, the exemplary considered laundry appliance 100 is configured to implement an auto-dosing functionality in which, at each treatment cycle (and when the auto-dosing functionality is activated), a predetermined amount of treatment agent (also referred to as treatment agent dose) is automatically taken by means of metering devices (e.g., pump devices, discussed in the following) from one or both of the multi-dose compartments 210(1),210(2).

Each multi-dose compartment 210(1),210(2) is preferably configurable to contain multiple doses of a respective type of treatment agent. For the purposes of the present disclosure, by type of treatment agent it is herein meant a class of treatment agents having same functions (in this sense, just as an example, pre-washing detergents, washing detergents and softeners identify respective types of treatment agents) or a class of treatment agents that, for the same functions, also have similar chemical properties or compositions or active ingredients (in this sense, just as an example, liquid washing detergents having, for example, different concentration levels or different surfactants may identify respective types of treatment agents).

For example, each multi-dose compartment 210(1), 210(2) may be configurable to contain multiple doses of a treatment agent for washing treatment (e.g., a liquid washing detergent), a treatment agent for softening treatment (e.g., a liquid softener), or a treatment agent for carrying out additional treatments (e.g., a rinsing additive) although this should not be construed limitatively.

As can be appreciated in FIG. 2A, the multi-dose compartments 210(1), 210(2) preferably have reciprocally different (or slightly different) areas. When, as herein exemplary considered, same or substantially same extensions along the vertical direction Z for the multi-dose compartments 210(1), 210(2) are assumed, this difference in area translates into correspondingly different capacities of the multi-dose compartments 210(1), 210(2), although this should not be construed limitatively.

The drawer 115 (particularly, the drawer body 210) preferably comprises one or more (two, in the example at issue) channels 215(1),215(2) associated with the multi-dose compartments 210(1),210(2) (in the example herein considered, each channel 215(1),215(2) is associated with a respective one of the multi-dose compartments 210(1),210(2), the channel 215(1) being for example associated with the multi-dose compartment 210(1) and the channel 215(2) being for example associated with the multi-dose compartment 210(2)). Each channel 215(1), 215(2) is preferably adapted to channel water and/or one or more treatment agent doses towards a region of the drawer seat 120 that allows a mixture between the water and the treatment agent dose(s) (hereinafter referred to as mixing region): the mixing region may for example be or comprise a bottom wall 220 of the drawer seat 120 (visible in FIG. 2B), the bottom wall 220 of the drawer seat 120 being advantageously slanted in order to promote a flow of the mixture between the water and the treatment agent dose(s) towards the treatment chamber of the laundry appliance 100.

As exemplary illustrated, the channels 215(1),215(2) are preferably provided, along the sliding direction X, behind the multi-dose compartments 210(1),210(2) (from the drawer front).

Advantageously, the channels 215(1),215(2) (or at least one thereof) extend vertically with respect to the rest surface (such as the floor) on which the laundry appliance 100 rests in operation (the channels 215(1),215(2) thus extending substantially along the vertical direction Z). In alternative embodiments of the present invention, the channels 215(1), 215(2) (or at least one thereof) are inclined with respect to the rest surface (such as the floor) on which the laundry appliance 100 rests in operation. Regardless of the specific (vertical or inclined) orientation of the channels 215(1),215(2), which is not limiting for the present invention, each channel 215(1),215(2) is advantageously structured and shaped such as to allow the water and/or the treatment agent dose(s) to fall towards the mixing region of the drawer seat 120 by gravity; in order to achieve it, each channel 215(1), 215(2) advantageously comprises a top channel input for receiving the water from a water distribution system above it (not shown), and a bottom channel output facing the bottom wall 220 of the drawer seat 120; in operation, the bottom channel outputs of the channels 215(1),215(2) are arranged for delivering the water and the treatment agent dose(s) to the bottom wall 220 of the drawer seat 120, and hence to the treatment chamber of the laundry appliance 100.

According to the preferred embodiment of the present invention herein considered and illustrated, the drawer 115 also comprises one or more (two, in the example at issue) drawer compartments 225(1), 225(2) each one adapted to contain a single dose of a respective treatment agent for performing a single treatment cycle, hereinafter referred to as mono-dose compartments 225(1),225(2); just as an example, the mono-dose compartment 225(1) may be arranged to contain a single dose of a powder or liquid washing detergent, whereas the mono-dose compartment 225(2) may be arranged to contain a single dose of a powder or liquid or pearl softener.

Preferably, the mono-dose compartments 225(1), 225(2) are, along the sliding direction X, between the drawer handle 205 and the multi-dose compartments 210(1), 210(2). Forming the mono-dose compartments 225(1), 225(2) before the multi-dose compartments 210(1),210(2) (along the sliding direction X, from the drawer handle 205) is advantageous in that a low or relatively low extraction of the drawer 115 is required for allowing the user to load the treatment agents in the mono-dose compartments 225(1), 225(2) (on the contrary, forming the mono-dose compartments 225(1), 225(2) behind the multi-dose compartments 210(1),210(2) would dramatically impair the mechanical stability of the drawer 115, for example when extracting the drawer 115 to load the treatment agents in the mono-dose compartments 225(1), 225(2) and a certain amount of treatment agent is still stored in one or more of the multi-dose compartments 210(1),210(2)).

As visible in the figures, the mono-dose 225(1),225(2) and multi-dose 210(1),210(2) compartments have different capacities; particularly, the multi-dose compartments 210(1),210(2) have larger capacities so as to store larger amounts of treatment agent as compared to the mono-dose compartments 225(1),225(2). Although the mono-dose compartments 225(1),225(2) are illustrated as having same or similar capacities, this should not be construed limitatively.

The laundry appliance 100 also comprises metering devices adapted to draw up treatment agent doses from the multi-dose compartments under the control of the control unit 130 according to a laundry appliance control mode selected by the selection unit 132.

Preferably, each metering device is associated with a respective multi-dose compartment 210(1),210(2). In the example herein considered of two multi-dose compartments 210(1),210(2), two metering devices each one for drawing up treatment agent doses from a respective multi-dose compartment 210(1),210(2) are provided.

According to an embodiment of the invention, the metering devices comprise pump devices, preferably, peristaltic pump devices. However, similar considerations apply in case different pump devices are used, as well as different metering devices such as for example comprising valve devices and/or hydraulic systems comprising Venturi pipes.

Making reference to the embodiment of the invention illustrated in the figures, the pump devices may for example be variable-flow peristaltic pump devices (in which case the control unit 130 may be configured to cause the pump devices to draw up the treatment agent doses by controlling rotor speeds of the pump devices), or fixed-flow peristaltic pump devices (in which case the control unit 130 may be configured to cause the pump devices to draw up the treatment agent doses by controlling activation times of the pump devices e.g., through duty cycle variations of corresponding control or driving signals). However, in alternative embodiment of the present invention, both variable-flow and fixed-flow peristaltic pump devices may be provided (for example, a variable-flow peristaltic pump device associated with one of the multi-dose compartments 210(1),210(2) and a fixed-flow peristaltic pump device associated with the other one of the multi-dose compartments 210(1),210(2)).

The pump devices are preferably provided, along the sliding direction X, behind the channels 215(1),215(2) (from the drawer front).

More preferably, the pump devices are structured such that electrical parts thereof are physically separate from drawer portions (such as the multi-dose compartments 210(1),210(2) and the channels 215(1),215(2)) experiencing treatment agent and/or water passage, and such that they are substantially unaffected by movement of the drawer 115 from the retracted position to the extracted position. In order to achieve it, each pump device preferably comprises a pump actuation part (advantageously provided in the drawer body 210) and an electrically-operated pump driving part (advantageously provided in the drawer seat 120) adapted to couple to each other when the drawer 115 is in the retracted position, upon said coupling the electrically-operated pump driving parts allowing driving of the pump actuation parts.

Each pump actuation part preferably comprises a respective suction side in fluid communication with the multi-dose compartment 210(1),210(2) for drawing up the treatment agent dose(s) therefrom, and a respective delivery side in fluid communication with the channel 215(1),215(2) for delivering the treatment agent dose(s) thereto.

Preferably, the drawer 115 comprises a suction pipe 222(1),222(2) (visible in FIG. 2A) coupling the suction side of the pump actuation part to an interior of the multi-dose compartment 210(1),210(2) for drawing up the treatment agent dose therefrom, and a delivery pipe 230(1),230(2) coupling the delivery side of the pump actuation part to an interior of the channel 215(1),215(2) for delivering the treatment agent dose thereto. The suction pipe 222(1),222(2) is preferably arranged, in the interior of the respective multi-dose compartment 210(1),210(2), proximate to a bottom wall of the multi-dose compartment 210(1),210(2), so as to allow drawing up of treatment agent doses even when the multi-dose compartment 210(1),210(2) is almost empty. The delivery pipe 230(1),230(2) preferably opens to the interior of the respective channel 215(1),215(2), preferably between (for example, in the middle or substantially in the middle of) the top channel input and the bottom channel output thereof (only end parts of the delivery pipes 230(1), 230(2) that open to the interior of the respective channels 215(1),215(2) being visible in FIG. 2A).

Each pump actuation part comprises a respective pumping member (not shown) adapted to push a quantity of the washing agent contained in a respective multi-dose compartment 210(1),210(2) through the respective suction 222(1),222(2) and delivery 230(1),230(2) pipes and, therefore, towards the mixing region of the drawer seat 120. Preferably, the suction 222(1),222(2) and delivery 230(1),230(2) pipes are in the form of deformable tubes, each pumping member preferably comprising a peristaltic rotor (not shown) being adapted to hydraulically cooperate with the respective deformable tubes. More preferably, each peristaltic rotor comprises one or more projecting portions (e.g. in the form of rollers, not visible) adapted to be arranged in contact with the walls of the respective deformable tube and capable of locally compressing it, thus generating a consequent narrowing that allows the fluid (i.e., the treatment agent dose(s)) to move during the rotation of the peristaltic rotor.

Each electrically-operated pump driving part may for example comprise an electric motor (not shown) selectively actuatable (e.g., by means of the electronic control unit 130) for operating the respective pumping member, and an output shaft (not shown) adapted to be fitted into a corresponding seat of the respective pumping member, so as to couple or engage with each other when the drawer 115 is moved to the retracted position.

Figure 2B:
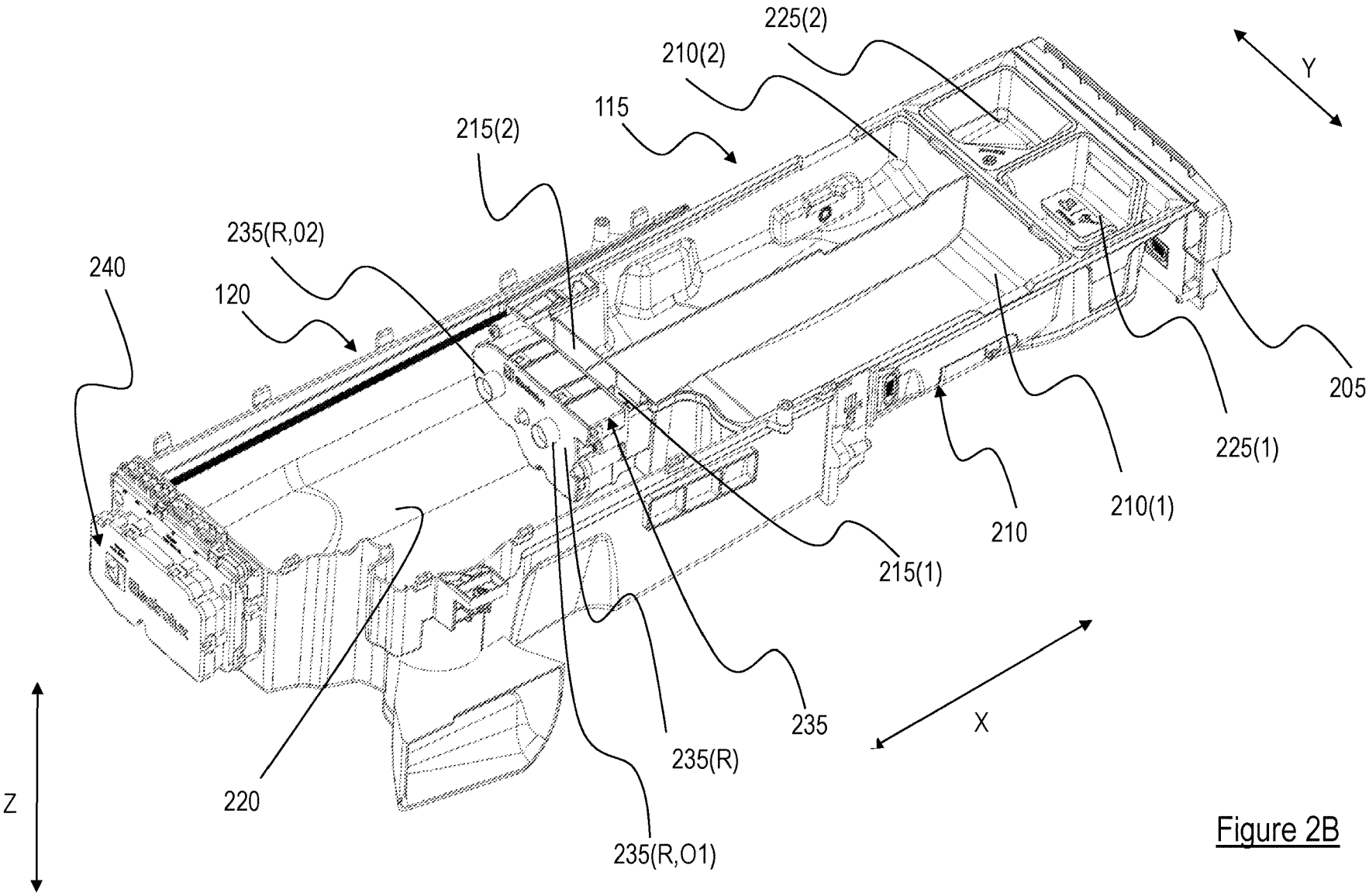
FIG. 2B shows a perspective view of the drawer of FIG. 2A in a partially extracted position within a drawer seat, according to an embodiment of the present invention.

The pumping members are advantageously enclosed, on a rear side of the drawer 115 (rear with respect to the drawer front along the sliding direction X), by a rotor shell 235 (visible in FIGS. 2A and 2B). More preferably, a rear wall 235(R) of the rotor shell 235 comprises openings (two openings 235(R,O1),235(R,O2) in the example at issue), through which the output shafts of the electric motors are able to pass for being coupled with the pumping members (particularly, with the seats thereof). Even more preferably, as illustrated, the openings 235(R,O1),235(R,O2) are delimited by walls (e.g., tubular walls) projecting along the sliding direction X from the rear wall 235(R) of the rotor shell 235; these projecting walls advantageously have centering, aligning and guiding functions for the output shafts to be passed into the openings 235(R,O1),235(R,O2).

The electric motors are advantageously enclosed in a motor shell 240 (visible in FIG. 2B), preferably fixed on the drawer seat 120 (and, hence, separate from drawer body 210) and facing the rear wall 235(R) of the rotor shell 235 along the sliding direction X. The motor shell 240 is preferably provided with openings, not shown, through which the output shafts of the electric motors project: in this way, when the drawer 115 is moved to the retracted position (i.e., towards the motor shell 240), the output shafts of the electric motors engage the pumping members, thus allowing mechanical and electrical connection therebetween.

Although not shown, the drawer 115 may comprise a drawer body cover for covering the drawer body 210. The drawer body cover may be configured to cover the drawer body 210 in correspondence of the multi-dose compartments 210(1),210(2), thus leaving uncovered both the channels 215(1),215(2), and particularly the top channel inputs thereof (which can therefore be accessed by water fed by a water distribution system, not shown, preferably provided at a top of the drawer seat 120). The drawer body cover may comprise one or more access openings, not shown, each one for accessing a respective multi-dose compartment 210(1), 210(2) for loading the treatment agent therein; one or more access components (such as one or more doors, for example one or more flap doors pivotally coupled to the drawer body cover) may advantageously be provided for selectively covering and uncovering the access openings thereby respectively preventing and allowing access to the respective multi-dose compartments 210(1),210(2).

As better discussed in the following, the type of treatment agent to be fed to the multi-dose compartments 210(1), 210(2) may advantageously be set by the user (e.g., through the user interface 125 and/or through the mobile application running on the user device UD).

According to an embodiment of the present invention:

- the multi-dose compartment 210(1) may be set to contain multiple doses of a first type of treatment agent (e.g., a washing detergent), and
- the multi-dose compartment 210(2) may be set to contain multiple doses of the (same) first type of treatment agent, or of a second type of treatment agent (e.g., a softener or a pre-washing detergent or a rinsing additive, or also a different washing detergent, such as a washing detergent having a different concentration level).

Figure 3A:
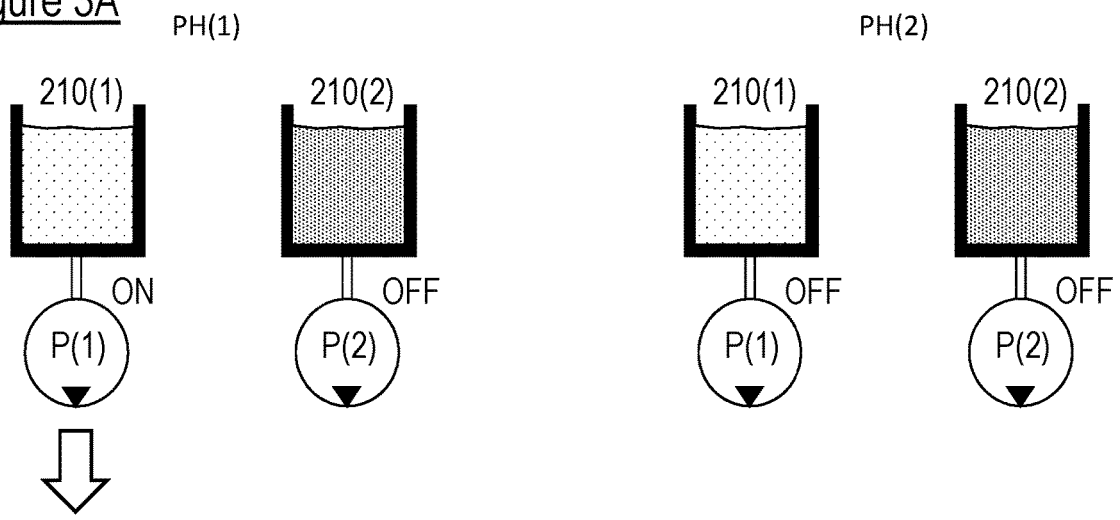
FIGS. 3A, 3B and 3C show examples of first, second and third laundry appliance control modes, respectively, according to an embodiment of the present invention.
Figure 3B:
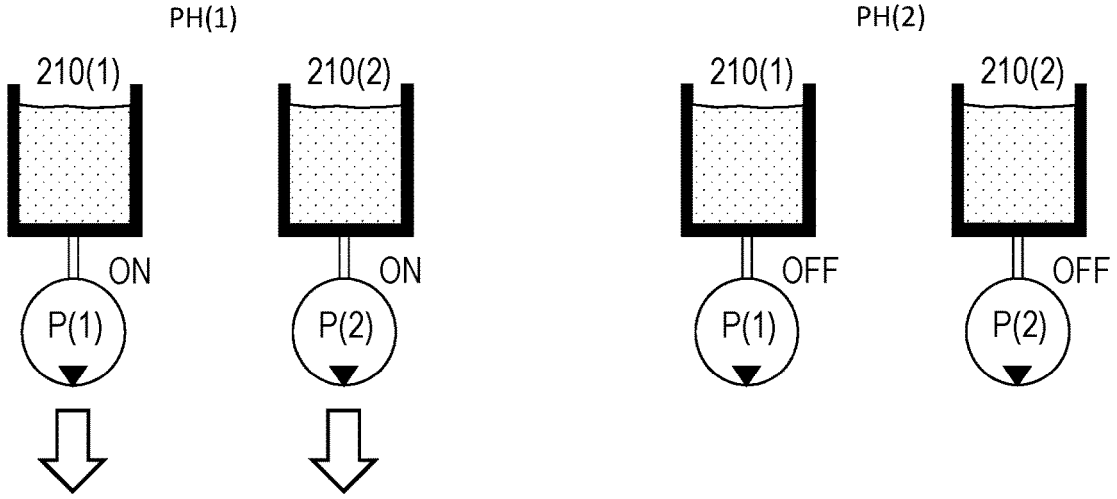
Figure 3C:
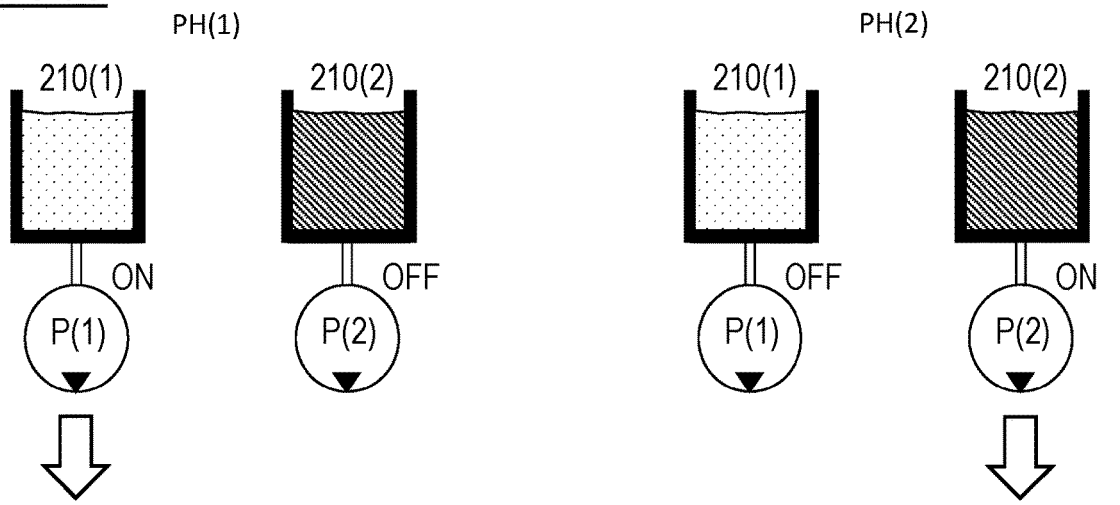

In order to describe in greater details how treatment agent doses are drawn up from the multi-dose compartments 210(1), 210(2) for being channeled (trough the channels 215(1), 215(2) and the bottom wall 220 of the drawer seat 120) towards the treatment chamber of the laundry appliance 100 based on a selected laundry appliance control mode according to an embodiment of the present invention, reference will be now made to FIGS. 3A, 3B and 3C.

In FIGS. 3A, 3B and 3C, the metering device (i.e. the pump device) associated with the multi-dose compartment 210(1) is schematically depicted with reference P(1), and the metering device (i.e. the pump device) associated with the multi-dose compartment 210(2) is schematically depicted with reference P(2).

Moreover, in FIGS. 3A, 3B and 3C, a first phase (e.g. a main washing phase) of a treatment cycle carried out by the laundry appliance 100 is identified with reference PH(1) and a subsequent second phase (e.g. a rinsing phase) of the same treatment cycle is identified with reference PH(2).

According to an embodiment of the present invention, the selection unit 132 is configured to select a control mode among a first control mode CM1 (an example of which is illustrated in FIG. 3A), a second control mode CM2 (an example of which is illustrated in FIG. 3B) and a third control mode CM3 (an example of which is illustrated in FIG. 3C).

According to an embodiment of the present invention, when the selection unit 132 selects the first control mode CM1, the control unit 130 causes a selected pump device between the pump devices P(1), P(2) to draw up a treatment agent dose from the respective multi-dose compartment 210(1), 210(2) during a selected phase between the first phase PH(1) and the second phase PH(2), and keeps off the other pump device during both the first and second phases PH(1), PH(2).

Making reference to the exemplary first control mode CM1 illustrated in FIG. 3A:

- during the first phase PH(1), the control unit 130 causes the activation of the pump device P(1) to draw up from the multi-dose compartment 210(1) a dose of the treatment agent contained therein, while keeping turned off the other pump device P(2);
- during the second phase PH(2), the control unit keeps turned off both the pump devices P(1) and P(2).

The first control mode CM1 is particularly suited to be selected when the treatment agent contained in the multi-dose compartment 210(1) and the treatment agent contained in the multi-dose compartment 210(2) are of different types but carry out the same function, and therefore are not suited to be used together during a same treatment cycle.

Therefore, when the first control mode CM1 is enabled, and the multi-dose compartment 210(1), 210(2) contains different types of treatment agents carrying out the same function, only one of these two treatment agents is drawn up from the respective pump device P(1), P(2) for being delivered to the treatment chamber of the laundry appliance 100 during a treatment cycle.

For example, in the first control mode CM1, the multi-dose compartment 210(1) may contain a washing detergent having a first concentration level, and the multi-dose compartment 210(2) may contain a washing detergent having a second concentration level different than the first concentration level. In this case, by selecting either the multi-dose compartment 210(1) or the multi-dose compartment 210(2) it is possible to carry out a treatment cycle using a different concentration level washing detergent.

Naturally, similar considerations apply in other cases entailed by the first control mode CM1, such as when:

- during the first phase PH(1) only the pump device P(2) is activated, and during the second phase PH(2) both the pump devices P(1) and P(2) are turned off;
- during the first phase PH(1) both the pump devices P(1) and P(2) are turned off, and during the second phase PH(2) only the pump device P(1) is activated;
- during the first phase PH(1) both the pump devices P(1) and P(2) are turned off, and during the second phase PH(2) only the pump device P(2) is activated.

According to an embodiment of the present invention, if the first control mode CM1 is selected, each one of the multi-dose compartment 210(1) and 210(2) may be associated to a respective group of treatment cycles, so that the control unit 130 is configured to (automatically) select one of the multi-dose compartments 210(1) and 210(2) according to the selected treatment cycle.

For example, the multi-dose compartment 210(1) may be associated to treatment cycles directed to washing operations for delicate laundry—this means that the multi-dose compartment 210(1) is configured to contain washing detergent of a type suitable to be employed with delicate laundry—and the multi-dose compartment 210(2) may be associated to treatment cycles directed to washing operations for normal, non-delicate, laundry—this means that the multi-dose compartment 210(2) is configured to contain washing detergent of a type suitable to be employed with normal, non-delicate laundry. In this case, the control unit 130 may be configured to cause the pump device P(1) to draw up a treatment agent dose from the multi-dose compartment 210(1) if the selected treatment cycle is a directed to perform washing operations for delicate laundry, and to cause the pump device P(2) to draw up a treatment agent dose from the multi-dose compartment 210(2) if the selected treatment cycle is a directed to perform washing operations for normal, non-delicate, laundry.

According to an embodiment of the present invention, the association between multi-dose compartments 210(1), 210(2) and treatment cycles may be already set according to factory settings.

According to an embodiment of the present invention, the association between multi-dose compartments 210(1), 210(2) and treatment cycles may be set by the user, for example through the user interface 125 and/or through (an app running on) the user device UD.

According to an embodiment of the present invention, if the control unit 130 is capable of automatically detecting the type of treatment agent included in the two multi-dose compartments 210(1), 210(2) (for example, by means of suitable treatment agent sensor), the association between multi-dose compartments 210(1), 210(2) and treatment cycles may be automatically and dynamically carried out by the control unit 130 itself.

For example, if the control unit 130 assessed that the multi-dose compartment 210(1) is filled with a washing detergent for delicate laundry and the multi-dose compartment 210(2) is filled with a washing detergent for normal, non-delicate, laundry, when the first control mode CM1 is selected, the control unit 130 may automatically associate:

- the multi-dose compartment 210(1) to treatment cycles directed to perform washing operations for delicate laundry, and
- the multi-dose compartment 210(2) to treatment cycles directed to perform washing operations for normal, non-delicate, laundry.

In this way, the control unit 130 may automatically cause the pump device P(1) to draw up a treatment agent dose from the multi-dose compartment 210(1) if the selected treatment cycle is directed to perform washing operations for delicate laundry, and cause the pump device P(2) to draw up a treatment agent dose from the multi-dose compartment 210(2) if the selected treatment cycle is directed to perform washing operations for normal, non-delicate, laundry.

According to an embodiment of the present invention, when the selection unit 132 selects the second control mode CM2, the control unit 130 causes both the pump devices P(1), P(2) to draw up treatment agent doses from the respective multi-dose compartments 210(1), 210(2) during at least one between the first phase PH(1) and the second phase PH(2).

Making reference to the exemplary second control mode CM2 illustrated in FIG. 3B:

during the first phase PH(1), the control unit 130 causes the activation of both the pump devices P(1) and P(2) to draw up from the respective multi-dose compartments 210(1), 210(2) a dose of the treatment agent contained therein;

during the second phase PH(2), the control unit keeps turned off both the pump devices P(1) and P(2).

The second control mode CM2 is particularly suited to be selected when the treatment agent contained in the multi-dose compartment 210(1) and the treatment agent contained in the multi-dose compartment 210(2) are of the same type, and therefore are suited to be used together during a same treatment cycle. In this case, the two multi-dose compartments 210(1), 210(2) are exploited in such a way to increase the overall capacity of the drawer 115 with respect to a single treatment agent.

Therefore, when the second control mode CM2 is enabled, and the multi-dose compartments 210(1), 210(2) contains the same type of treatment agent, the operations carried out by the laundry appliance 100 during a treatment cycle exploit doses of the same treatment agent drawn up from both the two multi-dose compartments 210(1), 210(2).

For example, in the second control mode CM2, the multi-dose compartments 210(1), 210(2) may contain a washing detergent.

In the second control mode CM2, a gradual concurrent emptying of both the two multi-dose compartments 210(1), 210(2) is preferably exhibited by the laundry appliance 100 over the treatment cycle.

Thanks to the gradual concurrent emptying of the multi-dose compartments 210(1), 210(2) allowed by the second control mode CM2, it is advantageously avoided that one of the two multi-dose compartments 210(1), 210(2) is emptied much before the other one and left unused for relatively long periods of time, avoiding thus the formation of encrustations which may reduce the performances of the laundry appliance 100.

Naturally, similar considerations apply in the other cases entailed by the second control mode CM2, such as when:

during the first phase PH(1) both the pump devices P(1) and P(2) are turned off, and during the second phase PH(2) both the pump devices P(1) and P(2) are activated;

during both the first phase PH(1) and the second phase PH(2) both the pump devices P(1) and P(2) are activated.

According to an embodiment of the present invention, when the selection unit 132 selects the third control mode CM3, the control unit 130 causes a selected pump device between the pump devices P(1), P(2) to draw up a treatment agent dose from the respective multi-dose compartment 210(1), 210(2) during a selected phase between the first phase PH(1) and the second phase PH(2), and causes the other pump device different from the selected pump device to draw up a treatment agent dose from the respective multi-dose compartment 210(1), 210(2) during the other phase different from the selected phase.

Making reference to the exemplary third control mode CM3 illustrated in FIG. 3C:

during the first phase PH(1), the control unit 130 causes the activation of the pump device P(1) to draw up from the multi-dose compartment 210(1) a dose of the treatment agent contained therein, while keeping turned off the other pump device P(2);

during the second phase PH(2), the control unit 130 causes the activation of the pump device P(2) to draw up from the multi-dose compartment 210(2) a dose of the treatment agent contained therein, while keeping turned off the other pump device P(1).

The third control mode CM3 is particularly suited to be selected when the treatment agent contained in the multi-dose compartment 210(1) and the treatment agent contained in the multi-dose compartment 210(2) are of different types and carry out different functions, and therefore are suited to be used during different phases of a same treatment cycle.

Therefore, when the third control mode CM3 is enabled, and the multi-dose compartment 210(1), 210(2) contains different types of treatment agents carrying out different functions, each one of said treatment agent is drawn up from the respective pump device P(1), P(2) for being delivered to the treatment chamber of the laundry appliance 100 during a respective phase of the treatment cycle to carry out a respective task.

For example, in the third control mode CM3, the multi-dose compartment 210(1) may contain a washing detergent, and the multi-dose compartment 210(2) may contain a softener. In this case, the first phase PH(1) may be a washing phase in which a dose of the washing detergent contained in the multi-dose compartment 210(1) is employed for performing washing operations on laundry located in the treatment chamber of the laundry appliance 100 while the second phase PH(2) may be a rinsing phase in which a dose of the softener contained in the multi-dose compartment 210(2) is employed for conditioning laundry located in the treatment chamber of the laundry appliance 100.

Naturally, similar considerations apply in the other cases entailed by the third control mode CM3, such as when, during the first phase PH(1), the pump device P(1) is kept off and the pump device P(2) is activated, while, during the second phase PH(2), the pump device P(1) is activated and the pump device P(2) is kept off.

Moreover, while in the description reference has been explicitly made to first and second phases that correspond to two respective specific treatment types (i.e., a first phase PH(1) corresponding to a washing phase of a treatment cycle and a second phase PH(2) corresponding to a rinsing phase of a treatment cycle), the concepts of the present invention can be applied also in case the phases correspond to other treatment types, such as for example a prewashing phase.

Figure 4A:
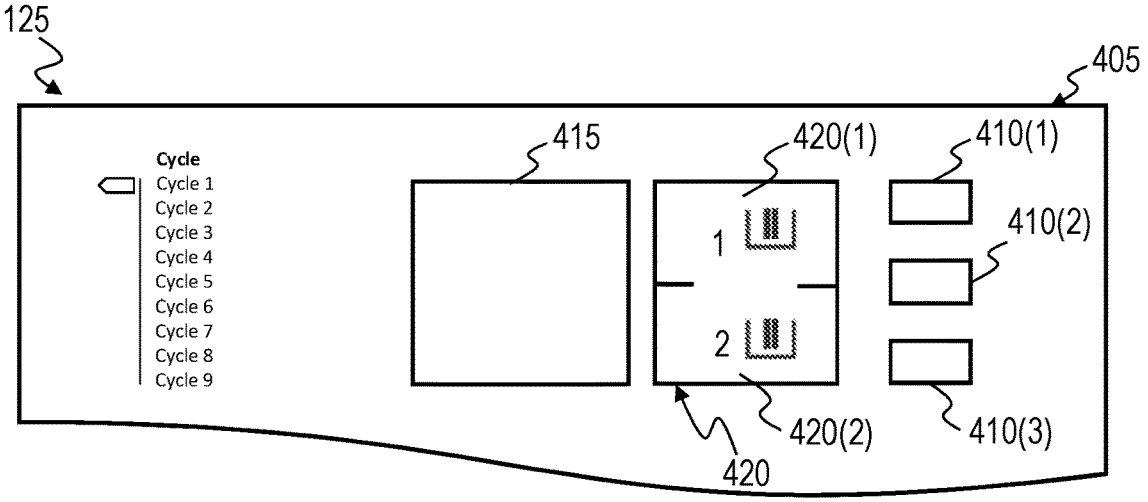
FIGS. 4A, 4B and 4C show portions of a user interface of the laundry appliance according to embodiments of the present invention.
Figure 4B:
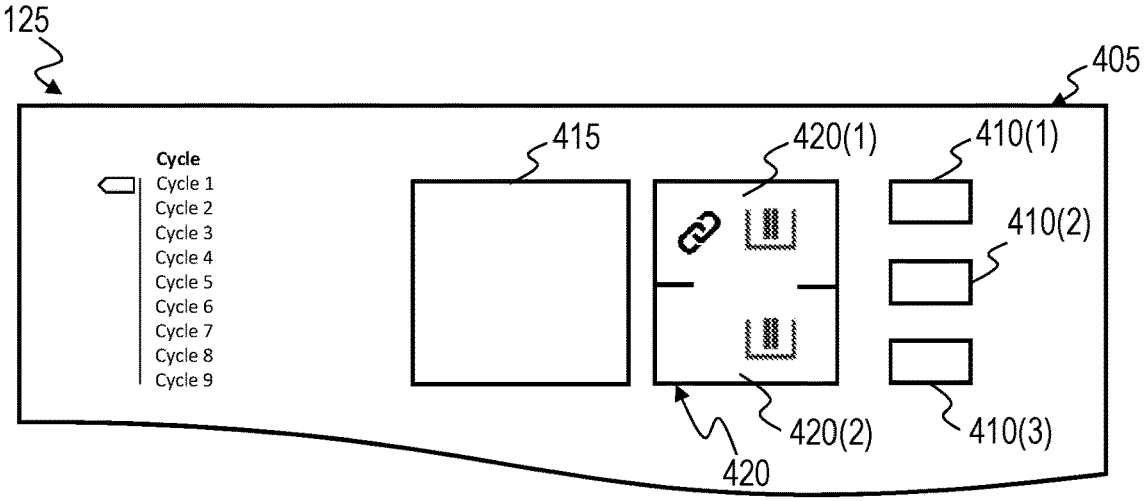
Figure 4C:
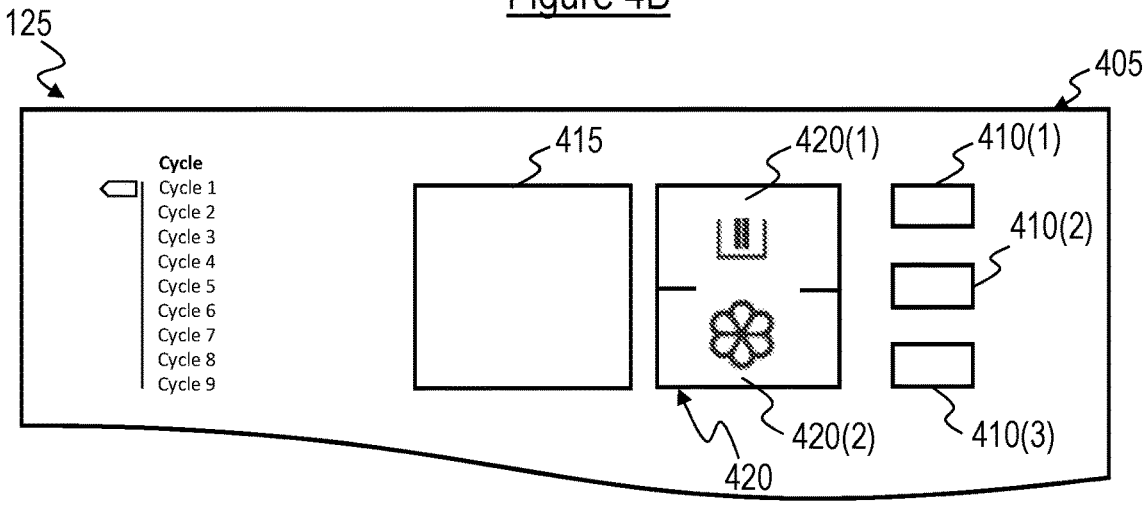

FIGS. 4A-4C show portions of the user interface 125 according to an embodiment of the present invention.

Preferably, although not necessarily, the user interface 125 comprises a display unit 405 for visually displaying one or more pieces of information; the display unit 405 may for example comprise a light emitting polymer display (LPD), a liquid crystal display, a thin film transistor-liquid crystal display, or an organic light-emitting diode display. In the preferred, not limiting, embodiment herein considered, the display unit 405 comprises a touch sensitive display unit to allow user selection of laundry appliance features by touching activated regions of the display unit 405.

The user interface 125 preferably comprises one or more input selectors for allowing the user to input selection commands such as selecting a treatment cycle and controlling one or more operating parameters of the selected treatment cycle (including, but not limited to, temperature, laundry load dirt level, spin speed, start time delay, drawer compartment selection, selection of the type of treatment agent). The input selectors may for example comprise physical input selectors, i.e. input selectors whose activation/deactivation is associated with displacements of mechanical components (such as the rotary knob visible in FIGS. 1A and 1B), and/or one or more virtual input selectors, i.e. input selectors whose activation/deactivation is associated with touch-sensitive electric components.

According to an embodiment of the present invention, the user interface 125 comprises at least one control mode input selector 410(*i*) for sending input selection commands to the selection unit 132 in order to select a laundry appliance control mode.

According to an embodiment of the present invention, each one of said at least one input selector 410(*i*) is associated with a corresponding set SCM(i) of control modes comprising at least one among said first control mode CM1, said second control mode CM2 and said third control mode CM3. As will be described in greater detail in the following of the description, by interacting with an input selector it is possible to select one of the control modes of the set of control modes associated to said input selector.

Making reference to the exemplary user interface 125 illustrated in FIGS. 4A-4C, three virtual input selectors are provided: a first input selector 410(1) associated with the first control mode CM1, a second input selector 410(2) associated with the second control mode CM2 and a third input selector 410(3) associated with the third control mode CM3. In this exemplary embodiment of the invention, each input selector 410(*i*) is associated with a corresponding set SCM(i) of control modes comprising a single control mode CMi.

According to this exemplary embodiment of the invention:

- if the user acts on (e.g., touches or press) the first input selector 410(1), a corresponding input selection command is sent to the selection unit 132 so that the selection unit 132 selects the first control mode CM1;
- if the user acts on (e.g., touches or press) the second input selector 410(2), a corresponding input selection command is sent to the selection unit 132 so that the selection unit 132 selects the second control mode CM2;
- if the user acts on (e.g., touches or press) the third input selector 410(3), a corresponding input selection command is sent to the selection unit 132 so that the selection unit 132 selects the third control mode CM3.

Although not shown, additional physical or virtual input selectors may be provided (e.g., additional physical or virtual input keys for setting one or more parameters of the selected treatment cycle, such as temperature, spin speed, amount of laundry load).

As exemplary illustrated, the display unit 405 comprises a cycle section, i.e. a section where a number of selectable treatment cycles are listed. The treatment cycles may be presented or listed with a graphic layout comprising textual indications (and/or symbols) associated with the selectable treatment cycles. The textual indications (and/or associated symbols) are preferably vertically superimposed one to the other in order to form a column of textual indications (and/or associated symbols). In the example illustrated, the treatment cycles are presented as a number of textual indications generically named "cycle 1", "cycle 2", "cycle 3", "cycle 4", "cycle 5", "cycle 6", "cycle 7", "cycle 8", "cycle 9", and may for example be conventional treatment cycles including, but not limited to, "Cottons", "Cotton ECO" "Synthetics", "Delicates", "Wool/Handwash". The treatment cycles may for example be selected through the above mentioned rotary knob, whose rotation advantageously causes a cursor or other pointer or slider to move vertically across the list of treatment cycle to visually indicate to the user the currently selected treatment cycle (however, embodiments of the present invention may be envisaged in which no rotary knob is provided and the cursor is a touch sensitive cursor moveable by user touch to select the treatment cycle).

As exemplary illustrated, the display unit 405 advantageously comprises a display region 415 for displaying status information such as information about a status of one or more components of the laundry appliances 100 and/or information about a status of the treatment cycle (including, but not limited to, information about a residual time to the end of the ongoing treatment cycle, and/or information about a current phase of the ongoing treatment cycle, and/or selected parameters for the ongoing treatment cycle).

Preferably, as illustrated, the display unit 405 comprises a display region (or more thereof) 420 for displaying a graphical indication of a (e.g., activated or deactivated) status the auto-dosing functionality. More preferably, the display region (or more thereof) 420 is arranged for displaying a graphical indication of the selected control mode. Even more preferably, the display region 420 comprises a (e.g., upper) display region 420(1) associated with the multi-dose compartment 210(1) and a (e.g., lower) display region 420(2) associated with the multi-dose compartment 210(2).

According to an exemplary but not limitative embodiment of the invention illustrated in FIG. 4A, when the first control mode CM1 is selected, the display region 420(1) associated with the multi-dose compartment 210(1) displays a washing detergent symbol provided with a "1" digit on side, while the display region 420(2) associated with the multi-dose compartment 210(2) displays a washing detergent symbol provided with a "2" digit on side. In this way, the user is provided with a clear and immediate indication about the laundry appliance 100 that is configured to have the multi-dose compartment 210(1) loaded with a first type of washing detergent and the multi-dose compartment 210(2) with a second type of washing detergent, and to carry out the next treatment cycle with a selected one between such two different types of washing detergents.

According to an exemplary but not limitative embodiment of the invention illustrated in FIG. 4B, when the second control mode CM2 is selected, both the display region 420(1) associated with the multi-dose compartment 210(1) and the display region 420(2) associated with the multi-dose compartment 210(2) display a washing detergent symbol, and at the same time a "chain link" is displayed. In this way the user is provided with a clear and immediate indication about the laundry appliance 100 that is configured to have the multi-dose compartments 210(1), 210(2) loaded with the same type of washing detergent, and to carry out the next treatment cycle by drawing up washing detergents from both the multi-dose compartments 210(1), 210(2) in such a way to preferably cause a gradual concurrent emptying thereof.

According to an exemplary but not limitative embodiment of the invention illustrated in FIG. 4C, when the third control mode CM3 is selected, the display region 420(1) associated with the multi-dose compartment 210(1) displays a washing detergent symbol, and the display region 420(2) associated with the multi-dose compartment 210(2) displays a softener symbol. In this way the user is provided with a clear and immediate indication about the laundry appliance 100 that is configured to have the multi-dose compartment 210(1) loaded with washing detergent and the multi-dose compartment 210(2) loaded with softener, and to carry out the next treatment cycle using the washing detergent during a phase of the treatment cycle and the softener during another phase of the treatment cycle.

Even if in the description reference has been explicitly made to a user interface 125 comprising three distinct input selectors each one associated with a respective single control mode among the control modes CM1, CM2, CM3, as already mentioned before, the concepts of the present invention can be directly applied to cases in which an input selector is associated to more than one control modes.

According to a first exemplary alternative, only two input selectors may be provided, and namely a first input selector associated with a corresponding set SCM(i) of control modes comprising the third control mode CM3 only and a second input selector associated a corresponding set SCM(i) of control modes comprising the first and second control modes CM1, CM2. The third control mode CM3 may be selected by touching/pressing the first input selector once, the first control mode CM1 may be selected by touching/pressing the second input selector once, and the second control mode CM2 may be selected by touching/pressing the second input selector twice. It has to be appreciated that several other solutions may be contemplated, which provide an interaction with the two input selectors using different touching/pressing sequences and/or timings.

According to a second exemplary alternative, only a single input selector may be provided, associated with a set of control nodes SCM(i) comprising all the three control modes CM1, CM2, CM3. Each control mode may be selected by touching/pressing the single input selector according a particular sequence and/or following a particular timing.

According to an embodiment of the present invention, the selection unit 132 is also configured to receive input selection commands from the user device UD. On this regard, input selectors may be provided on an application running on the user device UD having same or similar functions of the input selectors previously described with reference to the user interface 125.

According to an alternative embodiment of the invention, the selection unit 132 is instead configured to receive input selection commands from the user device UD only.

According to an embodiment of the present invention, the input selectors of the user interface 125 may be configured, for example through a proper application running on the user device UD, in order to add/remove control modes from the set SCM(i) of control modes associated with the input selectors.

Through said configuration it is advantageously possible to selectively enable/disable the possibility of selecting specific control modes trough the input selector(s).

Making for example reference to the exemplary user interface 125 illustrated in FIGS. 4A-4C, wherein the input selector 410(1) is associated with a set SCM(1) of control modes comprising the first control mode CM1 only, the second input selector 410(2) is associated with a set SCM(2) of control modes comprising the second control mode CM2 only and the third input selector 410(3) is associated with a set SCM(3) of control modes comprising the third control mode CM3 only, the possibility of selecting the first control mode CM1 may be disabled by configuring the input selector 410(1) so as to remove the first control mode CM1 from the set SCM(1). In this situation, the first control mode CM1 cannot be selected anymore because said control mode is no longer included in any of the sets SCM(i) associated to the input selectors.

According to an embodiment of the present invention, the control unit 130 is advantageously configured to identify the type of treatment agent contained in the multi-dose compartment 210(1) and/or the type of treatment agent contained in the multi-dose compartment 210(2).

On this regard, according to an embodiment of the present invention, the user of the laundry appliance 100 may directly input information regarding the type of treatment agent contained in the multi-dose compartment 210(1) and/or in the multi-dose compartment 210(2), such as for example through dedicated input selectors (not illustrated) provided on the user interface 125 or by exploiting a proper application running on the user device UD. Similar considerations apply if information regarding the type of treatment agent contained in the multi-dose compartments 210(1), 210(2) is input by the user by exploiting (e.g., at least one of) the input selectors 410(*i*) for the input selection commands directed to the selection of the laundry appliance control modes.

In addition or in alternative to the abovementioned information directly input by the user, the control unit 130 may be configured to identify the type of treatment agent contained in the multi-dose compartments 210(1), 210(2) according to information generated by treatment agent sensors (not illustrated) located at the multi-dose compartment 210(1) and/or the multi-dose compartment 210(2).

According to an embodiment of the present invention, the knowledge of the type of treatment agent contained in the multi-dose compartment 210(1) and/or the type of treatment agent contained in the multi-dose compartment 210(2) is advantageously exploited by the control unit 130 in order to automatically configure the input selectors of the user interface 125. More specifically, according to this embodiment of the invention, the control unit 130 is configured to carry out an automatic configuration of the input selectors in order to disable the possibility of selecting control modes which are not suitable to be used with the treatment agent(s) actually stored in the multi-dose compartments 210(1) and/or 210(2).

For example, if the control unit 130 is aware that the multi-dose compartment 210(1) contains a first type of washing detergent and the multi-dose compartment 210(2) contains a second type of treatment agent different from the first type, the control unit 130 may automatically configure the input selectors in such a way to disable the possibility of selecting the second control mode CM(2), since said control mode is only suitable for a condition in which both the multi-dose compartments 210(1), 210(2) contain doses of the same type of treatment agent.

According to an embodiment of the present invention, the knowledge of the type of treatment agent contained in the multi-dose compartment 210(1) and/or the type of treatment agent contained in the multi-dose compartment 210(2) is advantageously exploited by the control unit 130 in order to assess a correct or incorrect status of the laundry appliance control mode selected through the input selectors 410(*i*).

By "correct status" or "incorrect status" of the selected control mode it is herein intended an evaluation about a suitability of performing a treatment cycle according to the selected control mode using the treatment agent(s) actually stored in the multi-dose compartments 210(1) and/or 210(2). A selected control mode is therefore considered to have an "incorrect status" when the treatment agent(s) actually stored in the multi-dose compartments 210(1) and/or 210(2) does/do not correctly match the selected control mode (e.g., when the selected control mode provides for having the multi-dose compartments 210(1) contain a washing detergent, while the multi-dose compartments 210(1) actually contains a softener).

Advantageously, when the control unit 130 assesses an incorrect status of the selected control mode, the control unit 130 is configured to carry out at least one among the following operations:

generate a warning (e.g., a visual/text warning displayed on the user interface 125 or sent to the user device UD, and/or an audio warning emitted by the laundry appliance 100);

prevent the drawn up of treatment agent from the multi-dose compartments 210(1) and/or 210(2) (e.g., by disabling the pump devices);

deselect the currently selected control mode, in order to allow the user to select another control mode suitable for the treatment agent(s) actually stored in the multi-dose compartments 210(1) and/or 210(2).

According to an embodiment of the present invention, the control unit 130 is configured to assess a correct status of the selected control mode if the first control mode CM1 is selected, and at the same time the multi-dose compartment 210(1) is assessed to contain at least a dose of a first type of treatment agent (e.g., a washing detergent) and the multi-dose compartment 210(2) is assessed to contain at least a dose of a second type of treatment agent (e.g., a different type of washing detergent).

According to an embodiment of the present invention, the control unit 130 is configured to assess an incorrect status if the first control mode CM1 is selected, and at the same time the multi-dose compartments 210(1), 210(2) are assessed to contain at least a dose of the same type of treatment agent.

According to an embodiment of the present invention, the control unit 130 is configured to assess a correct status of the selected control mode if the second control mode CM2 is selected, and at the same time the multi-dose compartment 210(1) is assessed to contain at least a dose of a first type of treatment agent (e.g., a washing detergent) and the multi-dose compartment 210(2) is assessed to contain at least a dose of the same first type of treatment agent.

According to an embodiment of the present invention, the control unit 130 is configured to assess an incorrect status if the second control mode CM2 is selected, and at the same time the multi-dose compartments 210(1), 210(2) are assessed to contain at least a dose of different types of treatment agent.

According to an embodiment of the present invention, the control unit 130 is configured to assess a correct status of the selected control mode if the third control mode CM3 is selected, and at the same time the multi-dose compartment 210(1) is assessed to contain a first type of treatment agent (e.g., a washing detergent) and the multi-dose compartment 210(2) is assessed to contain a second type of treatment agent (e.g., a softener).

According to an embodiment of the present invention, the control unit 130 is configured to assess an incorrect status if the third control mode CM3 is selected, and at the same time the multi-dose compartments 210(1), 210(2) are assessed to contain at least a dose of the same type of treatment agent.

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars.

The invention claimed is:

1. Laundry treatment appliance for treating laundry according to at least one treatment cycle comprising:

a first phase and a second phase, the laundry treatment appliance comprising:

a drawer comprising a first compartment and a second compartment, the first compartment being configured to contain multiple doses of a first type of laundry treatment agent and the second compartment being configured to contain multiple doses of the first type of laundry treatment agent or of a second type of laundry treatment agent;

first and second metering devices configured to draw up treatment agent doses from the first and second compartments, respectively;

a control unit configured to control the first and second metering devices;

a selection unit configured to select a control mode among a first, a second, and a third control mode, the control unit being configured to control the first and second metering devices according to the selected control mode, wherein in the first control mode, the first compartment contains the first type of laundry treatment agent, the second compartment contains the second type of laundry treatment agent, and the control unit is configured to (i) operate the first metering device to draw up a treatment agent dose during the first phase or the second phase while the second metering device is kept off during both the first and second phases, or (ii) operate the second metering device to draw up a treatment agent dose during the first phase or the second phase while the first metering device is kept off during both the first and second phases;

in the second control mode, the first compartment contains the first type of laundry treatment agent, the second compartment contains the first type of laundry treatment agent, and the control unit is configured to operate both the first and second metering devices to draw up respective treatment agent doses during at least one of the first phase or the second phase;

in the third control mode, the first compartment contains the first type of laundry treatment agent, the second compartment contains the second type of laundry treatment agent, and the control unit is configured to operate the first metering device to draw up a treatment agent dose during the first phase, and the control unit is configured to operate the second metering device to draw up a treatment agent dose during the second phase; and at least one input selector configured to allow the user to input selection commands to select a control molds among the first, second and third control molds, wherein the control unit is further configured to identify a type of laundry treatment agent contained in the first compartment, the second compartment, or both according to information input by a user, information generated by laundry treatment agent sensors located at the first and second compartments, or both, and configure the at least one input selector by adding or removing control modes according to the identified type of laundry treatment agent.

2. The laundry treatment appliance of claim 1, wherein the at least one input selector is configurable through an external device being external to the laundry treatment appliance for adding/removing control modes from the corresponding set of control modes.

3. The laundry treatment appliance of claim 1, wherein the selection unit is further configured to receive input selection commands through an external device being external to the laundry treatment appliance.

4. The laundry treatment appliance of claim 1, wherein the control unit is further configured to assess a correct or incorrect status of the selected control mode based on the identified types of laundry treatment agent, and, upon assessing an incorrect status, carry out at least one among the following operations:

generate a warning;

prevent the first and second metering devices to draw up treatment agent doses from the first and/or second compartments;

deselect the selected control mode.

5. The laundry treatment appliance of claim 4, wherein the control unit is configured to assess a correct status if:

the first control mode is selected; and the first compartment contains at least a dose of the first type of laundry treatment agent and the second compartment contains at least a dose of the second type of laundry treatment agent.

6. The laundry treatment appliance of claim 4, wherein the control unit is configured to assess a correct status if:

the second control mode is selected; and the first compartment contains at least a dose of the first type of laundry treatment agent and the second compartment contains at least a dose of the first type of laundry treatment agent.

7. The laundry treatment appliance of claim 4, wherein the control unit is configured to assess a correct status if:

the third control mode is selected; and the first compartment contains at least a dose of the first type of laundry treatment agent and the second compartment contains at least a dose of the second type of laundry treatment agent.

8. The laundry treatment appliance of claim 1, wherein the first metering device comprises a first pump device and the second metering device comprises a second pump device.

9. The laundry treatment appliance of claim 1, wherein the first phase and the second phase are selected among:

a prewashing phase;

a washing phase; and a rinsing phase.

10. A laundry treatment appliance for treating laundry according to at least one treatment cycle comprising a first phase and a second phase, the laundry treatment appliance comprising:

a drawer comprising a first compartment and a second compartment, the first compartment being configured to contain multiple doses of a first type of laundry treatment agent and the second compartment being configured to contain multiple doses of the first type of laundry treatment agent or of a second type of laundry treatment agent;

first and second metering devices configured to draw up treatment agent doses from the first and second compartments, respectively;

a control unit configured to control the first and second metering devices;

a selection unit configured to select a control mode among a first, a second, and a third control mode, the control unit being configured to control the first and second metering devices according to the selected control mode, wherein in the first control mode, the control unit is configured to operate the first metering device to draw up a treatment agent dose during the first phase or the second phase, and the second metering device is kept off during both the first and second phases;

in the second control mode, the control unit is configured to operate both the first and second metering devices to draw up respective treatment agent doses during at least one of the first phase or the second phase;

in the third control mode, the control unit is configured to operate the first metering device to draw up a treatment agent dose during the first phase, and the control unit is configured to operate the second metering device to draw up a treatment agent dose during the second phase, and wherein the control unit is further configured to assess a correct or incorrect status of the selected control mode based on the type of laundry treatment agent contained in the first and/or second compartments, and, upon assessing an incorrect status, carry out at least one of the following operations: generate a warning; prevent the first and second metering devices to draw up treatment agent doses from the first and/or second compartments; or deselect the selected control mode.

11. The laundry treatment appliance of claim 10, further comprising at least one input selector configured to allow a user to input selection commands, the selection unit being configured to select the control mode according to the selection commands input by the user.

12. The laundry treatment appliance of claim 11, wherein the at least one input selector is associated with a corresponding set of control modes comprising at least one of the first, second and third control modes and is configured to allow the user to input selection commands to select a control mode among the corresponding set of control modes.

13. The laundry treatment appliance of claim 11, wherein the at least one input selector is configurable through an external device being external to the laundry treatment appliance for adding or removing control modes from the corresponding set of control modes.

14. The laundry treatment appliance of claim 10, wherein the control unit is configured to assess a correct status if: the first control mode is selected; and the first compartment contains at least a dose of the first type of laundry treatment agent and the second compartment contains at least a dose of the second type of laundry treatment agent.

15. The laundry treatment appliance of claim 10, wherein the control unit is configured to assess a correct status if: the second control mode is selected; and the first compartment contains at least a dose of the first type of laundry treatment agent and the second compartment contains at least a dose of the first type of laundry treatment agent.

16. The laundry treatment appliance of claim 10, wherein the control unit is configured to assess a correct status if: the third control mode is selected; and the first compartment contains at least a dose of the first type of laundry treatment agent and the second compartment contains at least a dose of the second type of laundry treatment agent.

* * * * *